US010590362B2

(12) United States Patent
Bardin et al.

(10) Patent No.: US 10,590,362 B2
(45) Date of Patent: Mar. 17, 2020

(54) PROCESS FOR PREPARING A COMPLEX CALCIUM SULPHONATE GREASE

(71) Applicant: TOTAL MARKETING SERVICES, Puteaux (FR)

(72) Inventors: Franck Bardin, Chambourcy (FR); Raphael Bruggeman, Veranne (FR)

(73) Assignee: Total Marketing Services, Puteaux (FR)

( * ) Notice: Subject to any disclaimer, the term of this patent is extended or adjusted under 35 U.S.C. 154(b) by 0 days.

(21) Appl. No.: 15/035,895

(22) PCT Filed: Nov. 12, 2014

(86) PCT No.: PCT/EP2014/074410
§ 371 (c)(1),
(2) Date: May 11, 2016

(87) PCT Pub. No.: WO2015/071331
PCT Pub. Date: May 21, 2015

(65) Prior Publication Data

US 2016/0272914 A1 Sep. 22, 2016

(30) Foreign Application Priority Data

Nov. 13, 2013 (FR) ..... 13 61087

(51) Int. Cl.
*C10M 121/04* (2006.01)
*C10M 177/00* (2006.01)

(52) U.S. Cl.
CPC ..... *C10M 121/04* (2013.01); *C10M 177/00* (2013.01); *C10M 2201/062* (2013.01); *C10M 2203/1006* (2013.01); *C10M 2203/1065* (2013.01); *C10M 2207/1225* (2013.01); *C10M 2207/1285* (2013.01); *C10M 2219/0466* (2013.01); *C10N 2210/02* (2013.01); *C10N 2230/06* (2013.01); *C10N 2230/08* (2013.01); *C10N 2230/10* (2013.01); *C10N 2230/12* (2013.01); *C10N 2230/18* (2013.01); *C10N 2230/68* (2013.01); *C10N 2250/10* (2013.01); *C10N 2270/00* (2013.01)

(58) Field of Classification Search
CPC ..... C10M 121/04; C10M 159/24; C10M 177/00; C10M 2201/062; C10M 2203/1006; C10M 2203/1065; C10M 2207/1225; C10M 2207/1285; C10M 2219/0466; C10N 2210/02; C10N 2230/06; C10N 2230/08; C10N 2230/10; C10N 2230/12; C10N 2230/18; C10N 2230/68; C10N 2250/10; C10N 2270/00
See application file for complete search history.

(56) References Cited

U.S. PATENT DOCUMENTS

| | | | | |
|---|---|---|---|---|
| 3,492,231 | A * | 1/1970 | McMillen | B01J 13/0082 508/393 |
| 4,560,489 | A | 12/1985 | Muir et al. | |
| 4,824,584 | A * | 4/1989 | Muir | C10M 159/24 508/401 |
| 5,126,062 | A | 6/1992 | Barnes | |
| 5,308,514 | A * | 5/1994 | Olson | C10M 159/24 508/155 |
| 5,338,467 | A | 8/1994 | Olson et al. | |
| 2013/0220704 | A1 | 8/2013 | Duckworth et al. | |

FOREIGN PATENT DOCUMENTS

CN 102703185 A 10/2012

OTHER PUBLICATIONS

Fish, Gareth et al., "Calcium Sulphonate Grease Formulation," The Lubrizol Corporation, 2012, 43 pages.

* cited by examiner

*Primary Examiner* — James C Goloboy
(74) *Attorney, Agent, or Firm* — Harness, Dickey & Pierce, PLC

(57) ABSTRACT

The present disclosure relates to a single-phase process for the preparation of a calcium sulphonate complex grease. More particularly, a single-phase process for the preparation of a calcium sulphonate complex grease in the absence of boric acid and including the implementation of at least one step under pressure.

17 Claims, No Drawings

PROCESS FOR PREPARING A COMPLEX CALCIUM SULPHONATE GREASE

CROSS-REFERENCE TO RELATED APPLICATIONS

This application is a National Phase Entry of International Patent Application No. PCT/EP2014/074410, filed on Nov. 12, 2014, which claims priority to French Patent Application Serial No. 1361087, filed on Nov. 13, 2013, both of which are incorporated by reference herein.

TECHNICAL FIELD

The present invention relates to the field of greases, and more particularly to the field of greases thickened with a calcium sulphonate complex soap. The invention relates to a single-phase process for the preparation of a calcium sulphonate complex grease. More particularly, the invention relates to a single-phase process for the preparation of a calcium sulphonate complex grease in the absence of boric acid and comprising the implementation of at least one step under pressure. The process according to the invention makes it possible to reduce the manufacturing time of a calcium sulphonate complex grease, while maintaining or even improving the manufacturing yield.

The present invention also relates to a production unit for the implementation of such a process. The present invention also relates to a calcium sulphonate complex grease capable of being obtained by a single-phase process in the absence of boric acid and comprising the implementation of at least one step under pressure. The grease according to the invention has in particular good mechanical properties as well as improved thermal resistance and extreme pressure properties.

BACKGROUND

Numerous applications exist where the liquid lubricants are not suitable because they "drift" with respect to the lubrication point. These are in particular rolling-contact bearings and slider bearings, open gear sets, metal cables and chain drives, and more generally for applications not comprising a sealing system. For these applications, lubricating greases are used, which are solid or semi-fluid substances resulting from the dispersion of a thickener in a liquid lubricant, optionally incorporating additives which give them specific properties.

The thickeners can be organic or inorganic compounds. Among the organic thickeners used in the manufacturing of greases, the fatty acid metal salts and polycarbamides (polyureas) can in particular be mentioned.

The vast majority of the lubricating greases are prepared with thickeners of the fatty acid metal salt type. The fatty acid is dissolved in the base oil at a relatively high temperature, and then an appropriate metal hydroxide is added. After evaporating the water which forms during the reaction by boiling, cooling is carried out for a precise amount of time, in order to form the soap lattice.

Lithium, sodium, calcium, barium, titanium or aluminium hydroxides, or certain aluminium trimers, are suitable for example as metal compounds for manufacturing grease. Long-chain fatty acids, of the order of C14 to C28, mainly C18, generally originate from vegetable (castor oil for example), or animal (for example tallow) oils. They can be hydrogenated or hydroxylated. The best-known derivative is 12-hydroxystearic acid originating from ricinoleic acid.

In combination with the long-chain fatty acids, it is also possible to use short-chain acids, typically comprising between 6 and 12 carbon atoms, such as for example azelaic acid, benzoic acid. Other, in particular inorganic, thickeners such as, for example, bentonite and silica gel can be used. For applications where the grease is located in an unconfined enclosure (for example open gear sets in cement works etc.), the greases thickened with metal soaps, and in particular with simple or complex metal soaps of aluminium are greatly superior to the other greases. The greases thickened with polyureas do not have sufficient mechanical stability, in particular due to their thixotropic nature, which leads to their becoming destructured under mechanical stresses. The inorganic thickeners also present problems of mechanical strength and water resistance.

The greases thickened with a calcium sulphonate complex soap (or calcium sulphonate complex greases) have been known and used for many years, as they have numerous properties such as extreme-pressure and anti-wear properties, mechanical resistance, corrosion resistance, water resistance and thermal stability, in particular at high temperatures. This type of grease is obtained from the conversion of an overbased calcium sulphonate in the presence in particular of at least one base oil, at least two different acids, one of which is a fatty acid and at least one base (cf. Gareth Fish et al, "Calcium Sulphonate Grease Formulation", 2012). They find their application in numerous industrial fields, in particular automobiles, the steel industry, mining operations or also paper manufacturing.

Several processes for the preparation of calcium sulphonate complex greases have already been described or implemented. Single-phase processes for the preparation of calcium sulphonate complex greases have in particular been described; the objective being to reduce the preparation time while maintaining or even improving the yield. By single-phase preparation process, is meant more particularly a process for the preparation of a calcium sulphonate complex grease comprising a single continuous rise in temperature and a single fall in temperature.

U.S. Pat. No. 5,338,467 describes a process for the preparation of a calcium sulphonate complex grease, the particles of calcium carbonate being in the form of calcite, said process being able to be implemented in a single phase and being able to include pressurizing the mixture constituting the grease. However, the examples of the process cited in this document all describe the presence of boric acid. The same is true for U.S. Patent Publication No. 2013/220704.

U.S. Pat. No. 4,560,489 describes a process for the preparation of a calcium sulphonate complex grease being able to be implemented in one phase and can include pressurizing the mixture constituting the grease. Moreover, this document describes that this process can be implemented in the absence of boric acid. However, this pressurization is carried out by the introduction of $CO_2$ into the reactor comprising the mixture. Moreover, the examples described in this document show the importance of the presence of boric acid on the thermal stability properties of the grease obtained at the end of the process. In fact, in the absence of boric acid, the thermal stability of the grease obtained at the end of the process is very low, whereas this stability improves with the increase in the boric acid content.

Document CN 102703185 describes a single-phase process for the preparation of a calcium sulphonate complex grease and the mixing of different components in a reactor under pressure. However, the process described in this document includes the presence of boric acid. Moreover, the pressurization of the mixture in the reactor is obtained by the addition of $CO_2$. Moreover, the process described in this document requires the presence of a co-solvent of the methanol or ethanol type, these co-solvents being able to give off volatile organic compounds (VOCs). Now, it is known that these compounds can represent a potential danger to human health.

It would therefore be desirable to have a process available for the preparation of a calcium sulphonate complex grease, which can be implemented both in a single phase and in the absence of boric acid. In fact, boric acid is a product classed as CMR (carcinogenic, mutagenic or toxic to reproduction) and therefore represents a potential danger to human health. It would also be desirable to have available a single-phase process for the preparation of a calcium sulphonate complex grease making it possible to significantly reduce the preparation time and maintain or even increase the yield, while retaining or even improving the properties of the grease. It would also be desirable to have available a single-phase process for the preparation of a calcium sulphonate complex grease, comprising at least one step of pressurizing the mixture constituting the grease, this pressurization not requiring the addition of gas, and in particular of carbon dioxide. It would also be desirable to have available a single-phase process for the preparation of a calcium sulphonate complex grease, not requiring the addition of solvents or co-solvents which give off VOCs.

An objective of the present invention is to provide a process overcoming all or some of the aforementioned drawbacks. Another objective of the invention is to provide a simple process which can be easily implemented. Another objective of the invention is to provide a calcium sulphonate complex grease the thermal stability of which is improved.

SUMMARY

Therefore an object of the invention is a process for the preparation of a calcium sulphonate complex grease comprising at least the following steps:

a) preparing, in a reactor, a calcium sulphonate complex soap comprising calcium carbonate, the calcium carbonate being presented in the form of calcite, b) closing the reactor, c) raising the temperature in the reactor to a temperature of at least 130° C. under a pressure of at least 400 kPa, d) depressurizing and removing the water contained in the reactor, e) cooling the reactor, said process not comprising the addition of boric acid.

Surprisingly, the applicant has found that it is possible to prepare a calcium sulphonate complex grease by a single-phase process including a step of pressurizing the mixture constituting the grease, without the addition of boric acid or co-solvent. Thus, the present invention allows implementation of a process for the preparation of a calcium sulphonate complex grease making it possible to maintain or even improve the yield, while reducing the preparation time.

Advantageously, the process according to the invention makes it possible to reduce or even eliminate the risks to human health. Advantageously, the process according to the invention makes it possible to reduce or even eliminate the risks of foaming phenomena. Advantageously, the calcium sulphonate complex grease obtained at the end of the process according to the invention has equivalent properties, in particular mechanical-stability and anti-wear properties, compared with the existing calcium sulphonate complex greases. Advantageously, the calcium sulphonate complex grease obtained at the end of the process according to the invention has improved properties, in particular thermal-resistance and extreme-pressure properties, compared with the existing calcium sulphonate complex greases.

Thus, the invention also relates to a calcium sulphonate complex grease capable of being obtained by a process comprising at least the following steps:

a) preparing, in a reactor, a calcium sulphonate complex soap comprising calcium carbonate, the calcium carbonate being presented in the form of calcite, b) closing the reactor, c) raising the temperature in the reactor to a temperature of at least 130° C. under a pressure of at least 400 kPa, d) depressurizing and removing the water contained in the reactor, e) cooling the reactor, said process not comprising the addition of boric acid.

The invention also relates to a production unit for the implementation of a process described above comprising:

- a reactor (1) provided with at least one stirring device (2) and at least one pressurizing (3) and heating (4) means,
- a tank (5) for receiving said calcium sulphonate complex grease,
- at least one means (6) for transferring said calcium sulphonate complex grease from the reactor (1) to the receiving tank (5).

DETAILED DESCRIPTION

The percentages indicated below correspond to the percentages by mass of active material with respect to the mass of the starting reagents. The process for the preparation of a calcium sulphonate complex grease according to the invention comprises at least the following steps:

a) preparing, in a reactor, a calcium sulphonate complex soap comprising calcium carbonate, the calcium carbonate being presented in the form of calcite, b) closing the reactor, c) raising the temperature in the reactor to a temperature of at least 130° C. and under a pressure of at least 400 kPa, d) depressurizing and removing the water contained in the reactor, e) cooling the reactor, said process not comprising the addition of boric acid.

In an embodiment of the invention, step a) comprises the steps of:

a.i) mixing, in the reactor, at least one base oil and at least one overbased calcium sulphonate, a.ii) adding at least one first carboxylic acid comprising at least 12 carbon atoms, and optionally at least one —OH group, at a temperature of at least 20° C., a.iii) adding at least one sulphonic acid comprising at least 12 carbon atoms at a temperature of at least 50° C., a.iv) adding water at a temperature of at least 50° C., a.v) adding at least one second carboxylic acid comprising at least 2 carbon atoms at a temperature of at least 50° C., a.vi) closing the reactor, a.vii) raising the temperature to a temperature of at least 80° C., a.viii) opening the reactor, a.ix) adding lime at a temperature of at least 90° C.

In another embodiment of the invention, steps a.i) to a.iii) can be implemented in a different order. Thus, the sulphonic acid comprising at least 12 carbon atoms can first be added to the mixture of step a.i) at a temperature of at least 50° C., then carboxylic acid comprising at least 12 carbon atoms, and optionally at least one —OH group can be added to the mixture thus obtained.

In a preferred embodiment of the invention, the order of implementation of steps a.iv) to a.ix) is fixed and therefore cannot be modified. Surprisingly, the applicant has found that it is possible to reduce or even eliminate the risks of foaming in the reactor when the order of implementation of steps a.iv) to a.ix) is strictly adhered to. Thus, by this limitation or even this elimination of the risks of foaming, the process according to the invention makes it possible to limit the risks of product loss during its implementation and therefore to optimize its yield.

Step a.i

The base oil of step a.i) according to the present invention can be selected from oils of mineral, synthetic or natural origin as well as mixtures thereof. The mineral or synthetic oils generally used for the preparation of grease belong to one of Groups I to V according to the classes defined in the API classification (or their equivalents according to the ATIEL classification) as summarized in Table I below. The API classification is defined in American Petroleum Institute 1509 "Engine oil Licensing and Certification System" 17th edition, September 2012. The ATIEL classification is defined in "The ATIEL Code of Practice", number 18, November 2012.

TABLE I

| | Saturates content | Sulphur content | Viscosity index |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | PAO (Poly Alpha Olefins) | | |
| Group V | Esters and other bases not included in bases of Groups I to IV | | |

The mineral base oils include any type of bases obtained by atmospheric and vacuum distillation of crude oil, followed by refining operations such as solvent extraction, deasphalting, solvent dewaxing, hydrotreatment, hydrocracking and hydroisomerization, hydrofinishing. The synthetic base oils can be selected from the esters, silicones, glycols, polybutene, polyalphaolefines (PAOs), alkylbenzene or alkylnaphthalene. The base oils can also be oils of natural origin, for example the esters of alcohols and carboxylic acids, which can be obtained from natural resources such as sunflower, rapeseed, palm, soya oil etc.

In an embodiment of the invention, the base oil of step a.i) is selected from the Group I base oils. In a preferred embodiment of the invention, the base oil of step a.i) is selected from the Group I base oils of Bright Stocks (BSS) type (distillation residue, with a kinematic viscosity at 100° C. of approximately 30 $mm^2/s$, measured according to the standard D-445, typically comprised between 28 and 32 $mm^2/s$, and with a density at 15° C. ranging from 895 to 915 $kg/m^3$), Group I base oils of an SN 330 type (distillate, with a density at 15° C. ranging from 880 to 900 $kg/m^3$, with a kinematic viscosity at 100° C. of approximately 12 $mm^2/s$ measured according to the standard D-445), the naphthenic Group I base oils (viscosity of 100 cSt at 40° C. measured according to the standard D-445) or mixtures thereof. In a more preferred embodiment of the invention, the base oil of step a.i) is a mixture of at least one Group I base oil of BSS type, a Group I base oil of SN 330 type and a naphthenic Group I base oil.

In step a.i) of the process according to the invention, at least one overbased calcium sulphonate is mixed with the base oil present in the reactor. This compound is known to a person skilled in the art as a detergent and is constituted by a calcium salt of a sulphonate. When the metal, i.e. calcium, is in excess (in a quantity greater than the stoichiometric quantity with respect to the anionic group (s) of the detergent), we are dealing with so-called overbased detergents. The excess metal providing the detergent with its overbased character is presented in the form of metal salts which are insoluble in oil, for example carbonate, hydroxide, oxalate, acetate, glutamate, preferentially carbonate.

In the same overbased detergent, the metals of these insoluble salts can be the same as those of the soluble detergents in the base oil or they can be different. They are preferentially selected from calcium, magnesium, sodium or barium. The overbased detergents are thus presented in the form of micelles composed of insoluble metal salts maintained in suspension in the base oil by the detergents in the form of oil-soluble metal salts. Preferably, the overbased calcium sulphonate is an overbased calcium sulphonate with calcium carbonate.

It is known that the BN (Base Number) of the overbased calcium sulphonates is high, preferably greater than 150 mg KOH/g of detergent. The BN is measured according to the standard ASTM D-2896. In an embodiment of the invention, the overbased calcium sulphonate of step a.i) has a BN of at least 300 mg KOH/g of detergent, preferably ranging from 300 to 500 mg KOH/g of detergent, advantageously from 350 to 450 mg KOH/g of detergent.

In a preferred embodiment of the invention, the content by weight of calcium sulphonate ranges from 35 to 55%, preferably from 40 to 50% with respect to the total weight of the starting reagents. In another preferred embodiment of the invention, the content by weight of base oil ranges from 45 to 65%, preferably from 50 to 60% with respect to the total weight of the starting reagents. In an embodiment of the invention, the mixture of step a.i) can be heated to a temperature of at least 60° C., preferably at least 70° C., advantageously from 70 to 80° C.

Step a.ii

In step a.ii) of the process according to the invention at least one carboxylic acid comprising at least 12 carbon atoms, and optionally at least one —OH group, is added at a temperature of at least 20° C. In an embodiment of the invention, the carboxylic acid of step a.ii) is selected from the carboxylic acids or the hydroxycarboxylic acids comprising from 12 to 24 carbon atoms, preferably from 16 to 20 carbon atoms. In a preferred embodiment of the invention, the carboxylic acid of step a.ii) is selected from the hydroxycarboxylic acids comprising from 12 to 24 carbon atoms, preferably from 16 to 20 carbon atoms.

Advantageously, the carboxylic acid of step a.ii) is 12-hydroxystearic acid. In a preferred embodiment of the invention, the content by weight of carboxylic acid ranges from 1 to 4%, preferably from 1.5 to 3% with respect to the total weight of the starting reagents.

In another embodiment, step a.ii) also comprises the addition of an anti-foaming additive. The anti-foaming additives used in greases are well known to a person skilled in the art and can be in particular selected from the silicon-containing compounds. In a preferred embodiment of the invention, the content by weight of anti-foaming additive ranges from 0.01 to 1% with respect to the total weight of the starting reagents. In an embodiment of the invention, step a.ii) is implemented at a temperature ranging from 20 to 60° C., preferably from 40 to 60° C.

Step a.iii

In step a.iii) of the process according to the invention at least one sulphonic acid comprising at least 12 carbon atoms is added at a temperature of at least 50° C. The liposoluble sulphonic acids which can be used in the process according to the invention are well known for preparing thick thixotropic compositions using a calcium sulphonate complex and in which the calcium carbonate is in the form of calcite crystals.

In an embodiment of the invention, the sulphonic acid of step a.iii) can be selected from the sulphonic acids of formula (I):

$$[(R1\text{-}A)x\text{-}SO3My] \quad (I)$$

in which:

$R_1$ represents a saturated or unsaturated, linear or branched alkyl group, comprising at least 10 carbon atoms, preferably from 10 to 30 carbon atoms, advantageously from 10 to 15 carbon atoms;

A represents an aromatic hydrocarbon-containing group, preferably a group selected from benzene, naphthalene or phenanthrene;

M represents a hydrogen atom or a calcium atom;

x represents 1 or 2;

y represents 1 or 2;

when M represents a calcium atom, y represents 2, when M represents a hydrogen atom, y represents 1.

In an embodiment of the invention, $R_1$ represents a saturated, linear or branched alkyl group comprising at least 10 carbon atoms, preferably from 10 to 30 carbon atoms, more preferentially from 10 to 15 carbon atoms, advantageously 12 carbon atoms. In another embodiment of the invention, A represents a benzene group. In another embodiment of the invention, x is equal to 1. In another embodiment of the invention, M represents a hydrogen atom and y is equal to 1.

In a preferred embodiment of the invention, the sulphonic acid of step a.iii) is dodecylbenzene sulphonic acid. In another preferred embodiment of the invention, the content by weight of sulphonic acid ranges from 0.5 to 4%, preferably from 1 to 3% with respect to the total weight of the starting reagents. In an embodiment of the invention, step a.iii) is implemented at a temperature ranging from 50 to 60° C., preferably from 50 to 55° C.

Step a.iv

In step a.iv) of the process according to the invention water is added. In an embodiment of the invention, the content by weight of water ranges from 1 to 10%, preferably from 3 to 8% with respect to the total weight of the starting reagents. In another embodiment of the invention, step a.iv) is implemented at a temperature ranging from 50 to 60° C.

Step a.v

In step a.v) of the process according to the invention at least one carboxylic acid comprising at least 2 carbon atoms is added at a temperature of at least 50° C. In an embodiment of the invention, the carboxylic acid of step a.v) can be selected from the carboxylic acids comprising from 2 to 6 carbon atoms, preferably from 2 to 4 carbon atoms. In a preferred embodiment of the invention, the carboxylic acid of step a.v) is acetic acid.

In another preferred embodiment of the invention, the content by weight of carboxylic acid ranges from 0.1 to 1%, preferably from 0.4 to 0.8% with respect to the total weight of the starting reagents. In an embodiment of the invention, step a.v) is implemented at a temperature of at least 60° C., preferably ranging from 60 to 65° C. In a preferred embodiment of the invention, the carboxylic acid comprising from 2 to 6 carbon atoms, preferably from 2 to 4 carbon atoms is slowly added to the mixture present in the reactor.

By slowly addition according to the invention, is meant the fact that not all the quantity of carboxylic acid is added to the mixture present in the reactor in a single go and/or over a very short period of time. In fact, the applicant has found that the fact of slowly adding the carboxylic acid comprising at least 2 to 6 carbon atoms, preferably 2 to 4 carbon atoms, to the mixture present in the reactor makes it possible to reduce or even eliminate the phenomena of foaming of the mixture present in the reactor.

Step a.vii

In step a.vii) of the process according to the invention the temperature is raised to a temperature of at least 80° C. In an embodiment of the invention, step a.vii) is implemented at a temperature of at least 85° C., preferably from 85 to 95° C. In a preferred embodiment of the invention, the temperature is maintained at 90° C. for a duration of at least 15 min, preferably ranging from 15 min to 1 h.

Step a.ix

In step a.ix) of the process according to the invention lime is added at a temperature of at least 90° C. By lime according to the invention, is meant more particularly calcium hydroxide. The lime can be presented in solid form such as a powder, or in liquid form such as an aqueous solution of lime. In a preferred embodiment of the invention, the lime is presented in the form of a powder.

In another preferred embodiment of the invention, the content by weight of added lime ranges from 0.1 to 4%, preferably from 0.5 to 2.5% with respect to the total weight of the starting reagents. In an embodiment of the invention, step a.ix) is implemented at a temperature ranging from 90 to 95° C. In another embodiment of the invention, step a.ix) can also comprise moreover the addition of at least one base oil. In a preferred embodiment of the invention, the base oil added in step a.ix) is identical to the base oil of step a.i). In a preferred embodiment of the invention, the content by weight of base oil added ranges from 1 to 20%, preferably from 5 to 15% with respect to the total weight of the starting reagents.

Step c

In step c) of the process according to the invention the temperature in the reactor is raised to a temperature of at least 130° C. under a pressure of at least 400 kPa. In an embodiment of the invention, the temperature of step c) ranges from 130 to 160° C., preferably from 130 to 150° C., advantageously 140° C. In a preferred embodiment of the invention, raising the temperature of step c) is carried out according to a temperature gradient ranging from 1 to 3° C./min.

In another preferred embodiment of the invention, the pressure of step c) ranges from 400 to 700 kPa, preferably from 500 to 650 kPa. In a more preferred embodiment of the invention, the pressure in the reactor in step c) is maintained at a pressure ranging from 500 to 650 kPa, preferably close to 600 kPa, at a temperature ranging from 130 to 150° C., preferably close to 140° C., for a duration of at least 15 min, preferably ranging from 15 to 80 min, advantageously from 15 to 60 min.

Surprisingly, the applicant has discovered that the implementation of step c) of the process according to the invention under such conditions allows an optimal conversion to calcite. By optimal conversion, is meant that all of the amorphous calcium carbonate has been converted to calcite and that therefore no more calcium carbonate remains in the amorphous form at the end of the process. The conversion of the amorphous calcium carbonate to calcite can be monitored by an infra-red spectrometry measurement method.

Without being bound by a particular theory, this complete conversion of the amorphous calcium carbonate to calcium carbonate in the form of calcite could be explained by the combination of a first reaction carried out in the absence of pressure, in particular in step a.vi) and of a second reaction carried out at a pressure of at least 400 kPa (after step a.ix)). In addition, the implementation of step c) of the process according to the invention in the absence of co-solvents which give off VOCs makes it possible to obtain a process for the preparation of a calcium sulphonate complex grease which poses very little or no danger to human health, and more particularly to the health of the people involved in its implementation.

Step d

In step d) of the process according to the invention depressurizing and removing the water contained in the reactor is carried out. Depressurizing can be implemented by different means well known to a person skilled in the art. In an embodiment of the invention, depressurizing is implemented by opening the reactor. In a preferred embodiment of the invention, the duration of depressurizing is at least 1 h, preferably ranging from 1 h to 3 h. In another preferred embodiment of the invention, depressurizing is implemented at a temperature of at least 130° C., preferably ranging from 130 to 150° C., advantageously close to 140° C. In a more preferred embodiment of the invention, depressurizing is implemented for a duration of at least 1 h and at a temperature of at least 130° C., preferably ranging from 130 to 150° C., advantageously close to 140° C.

Implementation of depressurizing under such temperature and time conditions allows in particular better control of the final consistency of the grease with the objective of obtaining a Grade 2 grease. During the depressurizing, all or part of the water contained in the mixture present in the reactor is removed. In order to remove all of the water contained in the mixture present in the reactor, a drawing off under vacuum can be applied to the mixture present in the reactor after depressurizing.

Thus, in a preferred embodiment of the invention, during the implementation of step d), depressurizing is followed by the application of a drawing off under vacuum of the mixture present in the reactor. The drawing off under vacuum can be implemented by different means, for example using a vacuum pump or a deaerator. The drawing off under vacuum can be implemented by different means, for example using a vacuum pump or a deaerator.

The process according to the invention can also comprise a step d.i) implemented after step d) and before step e) and comprising the supplementary addition of at least one base oil. In a preferred embodiment of the invention, the base oil added in step d.i) is identical to the base oil of step a.i). In a preferred embodiment of the invention, the content by weight of base oil ranges from 1 to 20%, preferably from 5 to 15% with respect to the total weight of the starting reagents.

Step e

In step e) of the process according to the invention the reactor is cooled. Cooling the reactor can be implemented by different means, for example by maintaining the reactor at ambient temperature, by placing a water circulation cooling device around the reactor, by placing a refrigerant device around the reactor etc. In an embodiment of the invention, the cooling is implemented by maintaining the mixture present in the reactor at ambient temperature.

In an embodiment of the invention, the cooling of step e) is implemented by lowering the temperature to a temperature of less than or equal to 90° C., preferably from 70 to 90° C. In a preferred embodiment of the invention, the cooling of step e) is implemented according to a drop ranging from 1 to 3° C./min, preferably close to 2° C./min.

Other Steps

The process according to the invention can also comprise a step f) implemented after step e) and comprising the addition of at least one supplementary additive, optionally followed by a step of grinding the product obtained. The additive can be selected from the additives well known to a person skilled in the art, such as antioxidant additives, for example antioxidants of the phenolic or amine type, anti-rust additives, such as for example dodecylsuccinic acid, calcium phenates, calcium salicylates, oxidized waxes or amine phosphates, corrosion-inhibiting additives such as tolyltriazoles or dimercaptothiadiazole derivatives, anti-foaming additives or mixtures thereof. In an embodiment of the invention, the additive is selected from the antioxidants, the anti-corrosion agents or mixtures thereof.

In another embodiment of the invention, the content by weight of additive ranges from 0.1 to 10%, preferably from 0.1 to 5% with respect to the total weight of the starting reagents. In an embodiment of the invention, the additive of step f) is added at a temperature of at most 90° C., preferably ranging from 60 to 90° C., advantageously from 70 to 90° C.

The invention also relates to a process for the preparation of a calcium sulphonate complex grease comprising at least the following steps:

a) preparing, in a reactor, a calcium sulphonate complex soap comprising calcium carbonate, the calcium carbonate being presented in the form of calcite, said preparation comprising the steps of:
   - a.i) mixing, in the reactor, at least one base oil and at least one overbased calcium sulphonate,
   - a.ii) adding at least one carboxylic acid comprising at least 12 carbon atoms, and optionally at least one —OH group, at a temperature of at least 20° C.,
   - a.iii) adding at least one sulphonic acid comprising at least 12 carbon atoms at a temperature of at least 50° C.,
   - a.iv) adding water at a temperature of at least 50° C.,
   - a.v) adding at least one carboxylic acid comprising at least 2 carbon atoms at a temperature of at least 50° C.,
   - a.vi) closing the reactor,
   - a.vii) raising the temperature to a temperature of at least 80° C.,
   - a.viii) opening the reactor,
   - a.ix) adding lime at a temperature of at least 90° C.,
b) closing the reactor,
c) raising the temperature in the reactor to a temperature of at least 130° C. under a pressure of at least 400 kPa,
d) depressurizing and removing the water contained in the reactor,
e) cooling the reactor, said process not comprising the addition of boric acid.

The invention also relates to a process for the preparation of a calcium sulphonate complex grease comprising at least the following steps:

a) preparing, in a reactor, a calcium sulphonate complex soap comprising calcium carbonate, the calcium carbonate being presented in the form of calcite, said preparation comprising the steps of:

a.i) mixing, in the reactor, at least one base oil and at least one overbased calcium sulphonate, a.ii) adding at least one carboxylic acid comprising at least 12 carbon atoms, and optionally at least one —OH group, at a temperature of at least 20° C., a.iii) adding at least one sulphonic acid comprising at least 12 carbon atoms at a temperature of at least 50° C., a.iv) adding water at a temperature of at least 50° C., a.v) adding at least one carboxylic acid comprising at least 2 carbon atoms at a temperature of at least 50° C., a.vi) closing the reactor, a.vii) raising the temperature to a temperature of at least 80° C., a.viii) opening the reactor, a.ix) adding lime at a temperature of at least 90° C., b) closing the reactor, c) raising the temperature in the reactor to a temperature of at least 130° C. under a pressure of at least 400 kPa, d) depressurizing and removing the water contained in the reactor, e) cooling the reactor, f) adding at least one supplementary additive to the reactor, said process not comprising the addition of boric acid.

All the characteristics and preferences presented for steps a), a.i), a.ii), a.iii), a.iv), a.v), a.vii), a.ix), b), c), d), e) and f) also apply to the processes above.

The invention also relates to a process for the preparation of a calcium sulphonate complex grease comprising at least the following steps:

a) preparing, in a reactor, a calcium sulphonate complex soap comprising calcium carbonate, the calcium carbonate being presented in the form of calcite, said preparation comprising the steps of:

a.i) mixing, in the reactor, from 45 to 65% by weight of at least one base oil and from 35 to 55% by weight of at least one overbased calcium sulphonate, with respect to the total weight of the starting reagents, a.ii) adding from 1 to 4% by weight, with respect to the total weight of the starting reagents, of at least one carboxylic acid comprising at least 12 carbon atoms, and optionally at least one —OH group, at a temperature of at least 20° C., a.iii) adding from 0.5 to 4% by weight, with respect to the total weight of the starting reagents, of at least one sulphonic acid comprising at least 12 carbon atoms at a temperature of at least 50° C., a.iv) adding from 1 to 10% by weight, with respect to the total weight of the starting reagents, of water at a temperature of at least 50° C., a.v) adding from 0.1 to 1% by weight, with respect to the total weight of the starting reagents, of at least one carboxylic acid comprising at least 2 carbon atoms at a temperature of at least 50° C., a.vi) closing the reactor, a.vii) raising the temperature to a temperature of at least 80° C., a.viii) opening the reactor, a.ix) adding from 0.1 to 4% by weight, with respect to the total weight of the starting reagents, of lime at a temperature of at least 90° C., b) closing the reactor, c) raising the temperature in the reactor to a temperature of at least 130° C. and under a pressure of at least 400 kPa, d) depressurizing and removing the water contained in the reactor, e) cooling the reactor, said process not comprising the addition of boric acid.

The invention also relates to a process for the preparation of a calcium sulphonate complex grease comprising at least the following steps:

a) preparing, in a reactor, a calcium sulphonate complex soap comprising calcium carbonate, the calcium carbonate being presented in the form of calcite, said preparation comprising the steps of:

a.i) mixing, in the reactor, from 45 to 65% by weight of at least one base oil and from 35 to 55% by weight of at least one overbased calcium sulphonate, with respect to the total weight of the starting reagents, a.ii) adding from 1 to 4% by weight, with respect to the total weight of the starting reagents, of at least one carboxylic acid comprising at least 12 carbon atoms, and optionally at least one —OH group, at a temperature of at least 20° C., a.iii) adding from 0.5 to 4% by weight, with respect to the total weight of the starting reagents, of at least one sulphonic acid comprising at least 12 carbon atoms at a temperature of at least 50° C., a.iv) adding from 1 to 10% by weight, with respect to the total weight of the starting reagents, of water at a temperature of at least 50° C., a.v) adding from 0.1 to 1% by weight, with respect to the total weight of the starting reagents, of at least one carboxylic acid comprising at least 2 carbon atoms at a temperature of at least 50° C., a.vi) closing the reactor, a.vii) raising the temperature to a temperature of at least 80° C., a.viii) opening the reactor, a.ix) adding from 0.1 to 4% by weight, with respect to the total weight of the starting reagents, of lime at a temperature of at least 90° C., b) closing the reactor, c) raising the temperature in the reactor to a temperature of at least 130° C. under a pressure of at least 400 kPa, d) depressurizing and removing the water contained in the reactor, e) cooling the reactor, f) adding from 0.1 to 10% by weight, with respect to the total weight of the starting reagents, of at least one supplementary additive to the reactor, said process not comprising the addition of boric acid.

All the characteristics and preferences presented for steps a), a.i), a.ii), a.iii), a.iv), a.v), a.vii), a.ix), b), c), d), e) and f) also apply to the processes above. The invention also relates to a calcium sulphonate grease capable of being obtained by a process described above. Depending on their consistency, the greases are divided into 9 NLGI (National Lubricating Grease Institute) classes or grades commonly used in the field of greases. These grades are indicated in the table below.

TABLE II

| Grade | |
|---|---|
| NLGI grade | Consistency according to ASTM D217 (tenths of a millimetre) |
| 000 | 445-475 |
| 00 | 400-430 |

TABLE II-continued

| Grade | |
|---|---|
| NLGI grade | Consistency according to ASTM D217 (tenths of a millimetre) |
| 0 | 355-385 |
| 1 | 310-340 |
| 2 | 265-295 |
| 3 | 220-250 |
| 4 | 175-205 |
| 5 | 130-160 |
| 6 | 85-115 |

In an embodiment, the greases according to the invention have a consistency comprised between 220 and 430 tenths of a millimetre according to the standard ASTM D217, in order to cover the grades 00, 0, 1, 2 and 3. In a preferred embodiment, the greases according to the invention have a consistency comprised between 265 and 295 tenths of a millimetre according to the standard ASTM D217, in order to cover grade 2.

Technical Performances of the Greases

The greases according to the invention have a very good thermal resistance. In particular, the greases according to the invention exhibit bleeding of less than 0.8% (percentage by mass of loss of oil) measured according to the standard ASTM D6184 (50 h, 100° C.) and bleeding of less than 0.5% (percentage by mass of loss of oil) measured according to the standard NF T60-191 (168 h, 40° C.). Moreover, the greases according to the invention are more stable when hot, and more particularly above 140° C. The greases according to the invention have good extreme-pressure performances. In particular, the greases according to the invention have a welding load measured according to the standard ASTM D2596 greater than 350 kg, preferably greater than or equal to 400 kg. In particular, the grease compositions according to the invention have a welding load measured according to the standard DIN 51350/4 greater than 350 daN, preferably greater than or equal to 360 daN, more preferentially greater than or equal to 370 daN, yet more preferentially greater than or equal to 380 daN (daN: decanewton). Moreover, the greases according to the invention have a rolling bearing wear, obtained by the FAG FE 8 test according to the standard DIN 51819, of less than 2.

The greases according to the invention are also not very corrosive, in particular vis-à-vis metals and metal alloys, and more particularly vis-à-vis copper. The invention also relates to a process for the lubrication of a mechanical part, comprising at least contacting the mechanical part with a grease such as defined above. All the characteristics and preferences presented for the grease also apply to the process for the lubrication of a mechanical part according to the invention.

The invention also relates to a production unit for a calcium sulphonate complex grease for the implementation of a process described above comprising:

- a reactor (1) provided with at least one stirring device (2) and at least one pressurizing (3) and heating (4) means,
- a receiving tank (5) for said calcium sulphonate complex grease,
- at least one means for transferring (6) said calcium sulphonate complex grease from the reactor (1) to the receiving tank (5).

In an embodiment of the invention, the reactor (1) has a capacity ranging from 2 to 10 tonnes, preferably from 3 to 6 tonnes. The stirring device (2) present in the reactor (1) can be selected from any type of stirring device known to a person skilled in the art and used in the preparation of a grease. By pressurizing means according to the invention, is meant any means making it possible to introduce and maintain a particular pressure inside the reactor. In an embodiment of the invention, the pressurizing means (3) can be an autoclave.

By heating means according to the invention, is meant any means making it possible to introduce a rise in temperature and to maintain a particular temperature inside the reactor. In an embodiment of the invention, the heating means (4) can be a boiler heating a heat-transfer fluid. In an embodiment of the invention, the receiving tank (5) has a capacity ranging from 2 to 10 tonnes, preferably from 3 to 6 tonnes. In an embodiment of the invention, the receiving tank (5) can also comprise at least one cooling means (7).

The cooling means can be selected from the cooling means used in step e) and described above. The transfer means (6) make it possible to convey the calcium sulphonate complex grease from the reactor (1) to the receiving tank (5). The transfer means (6) can be in particular selected from circulation pumps or pipes. In an embodiment of the invention, the transfer means comprise a circulation pump (8) capable of pumping the calcium sulphonate complex grease to the outside of the reactor (1) in order for it to be transferred into the receiving tank (5).

In another embodiment of the invention, the production unit also comprises an additives tank (9). By additives tank according to the invention, is meant any tank containing at least one additive intended to be added to the mixture present in the reactor (1).

The different objects of the present invention and their implementations will be better understood on reading the examples which follow. These examples are given by way of indication, without being limitative.

EXAMPLES

Example 1 (According to the Invention)

Process a for the Preparation of a Grease

A grease composition was prepared according to a process A according to the invention comprising the following steps:

- In a reactor, a mixture comprising 18.9% by weight of a Group I base oil of SN 330 type (density at 15° C. ranging from 880 to 900 kg/m$^3$, kinematic viscosity at 100° C. of approximately 12 mm$^2$/s measured according to the standard ASTM D-445), 22.5% by weight of a Group I base oil of BSS type (kinematic viscosity at 100° C. of approximately 30 mm$^2$/s measured according to the standard ASTM D-445 and density at 15° C. ranging from 895 to 915 kg/m$^3$), 13.5% by weight of a naphthenic Group I base oil (viscosity of 100 cSt at 40° C. measured according to the standard ASTM D-445) and 45.1% by weight of an overbased calcium sulphonate with a BN measured according to the standard ASTM D-2896 equal to 400 mg KOH/g of detergent was prepared, the percentages corresponding to percentages with respect to the total weight of the starting reagents,
- The mixture in the reactor was heated to a temperature of 75° C. according to a temperature gradient of 1.5° C./min,
- At a temperature of 50° C., 2.2% by weight of 12-hydroxystearic acid, with respect to the total weight of the starting reagents, and 0.01% by weight of an anti-foaming agent of silicone type, with respect to the total weight of the starting reagents, were added into the reactor, At a temperature of 55° C., 2.4% by weight, with respect to the total weight of the starting reagents, of dodecylbenzene sulphonic acid was added into the reactor, At a temperature of 57° C., 6% by weight, with respect to the total weight of the starting reagents, of water was added into the reactor, At a temperature comprised between 60 and 65° C., 0.7% by weight, with respect to the total weight of the starting reagents, of acetic acid was slowly added into the reactor, The reactor was closed then the temperature was raised to 90° C. and this temperature was maintained for a duration of 30 min, The reactor was opened and 0.9% by weight, with respect to the total weight of the starting reagents, of lime as well as 10.5% by weight, with respect to the total weight of the starting reagents, of a Group I base oil of BSS type (kinematic viscosity at 100° C. of approximately 30 $mm^2/s$ measured according to the standard ASTM D-445 and density at 15° C. ranging from 895 to 915 $kg/m^3$) were added into the reactor at a temperature of 90° C., The reactor was closed again, A pressure of 600 kPa was applied inside the reactor while heating in order to raise the temperature to 140° C., This temperature was maintained for a duration of 1 h, Depressurizing was then applied to the reactor, this being carried out for at least 1 h at a temperature of 140° C. by opening the reactor (opening the bypass), At a temperature of 140° C., 9.5% by weight, with respect to the total weight of the starting reagents, of a Group I base oil of BSS type (kinematic viscosity at 100° C. of approximately 30 $mm^2/s$ measured according to the standard ASTM D-445 and density at 15° C. ranging from 895 to 915 $kg/m^3$) was slowly added The temperature was brought back to 80° C. according to a gradient of 2° C./min, At a temperature of 80° C., 0.5% by weight, with respect to the total weight of the starting reagents, of a package of additives comprising an amine antioxidant (Irganox L57 from the BASF company) was added, The mixture present in the reactor is then subjected to grinding using a Fryma corundum grinding mill from the frymaKoruma company.

Example 2 (Comparative)

Process B for the Preparation of a Grease

A grease was prepared according to process A in which a derivative of boric acid (calcium metaborate) was added to the mixture present in the reactor: the calcium metaborate was added in a quantity of 2.9% by weight with respect to the total weight of the starting reagents, with the package of additives comprising an amine antioxidant and at a temperature of approximately 80° C. The calcium metaborate behaves in the same way as boric acid, the only difference is that calcium metaborate is not a product that is classed as CMR.

Example 3 (Comparative)

Process C for the Preparation of a Grease

A grease was prepared according to a comparative process C, in two phases in the presence of boric acid comprising the following steps:

First Phase

In a reactor, a mixture comprising 17.5% by weight of a Group I base oil of SN 330 type (density at 15° C. ranging from 880 to 900 $kg/m^3$, kinematic viscosity at 100° C. of approximately 12 $mm^2/s$ measured according to the standard ASTM D-445), 28.5% by weight of a Group I base oil of BSS type (kinematic viscosity at 100° C. of approximately 30 $mm^2/s$ measured according to the standard ASTM D-445 and density at 15° C. ranging from 895 to 915 $kg/m^3$), 12.2% by weight of a naphthenic Group I base oil (viscosity of 100 cSt at 40° C. measured according to the standard ASTM D-445) and 41.6% of an overbased calcium sulphonate with a BN measured according to the standard ASTM D-2896 equal to 400 mg KOH/g of detergent was prepared, the percentages corresponding to percentages with respect to the total weight of the starting reagents, The mixture in the reactor was heated to a temperature of 75° C. according to a temperature gradient of 1.5° C./min, At a temperature of 50° C., 1.2% by weight, with respect to the total weight of the starting reagents, of 12-hydroxystearic acid was added into the reactor, At a temperature of 55° C., 2.2% by weight, with respect to the total weight of the starting reagents, of dodecylbenzene sulphonic acid was added into the reactor, At a temperature of 57° C., 5.6% by weight, with respect to the total weight of the starting reagents, of water was added into the reactor, At a temperature comprised between 60 and 65° C., 0.7% by weight, with respect to the total weight of the starting reagents, of acetic acid was slowly added into the reactor, The reactor was closed, A rise under pressure to 120° C. during 1 h (according to a rate of 2° C./min) was carried out, After this step, while maintaining the pressure inside the reactor between 200 and 250 kPa, the temperature was lowered to 90° C., Depressurizing was then applied to the reactor, by opening the latter, Second Phase At a temperature of 90° C. 1.4% of 12-hydroxystearic acid, 2.5% of lime and 2.1% of boric acid were added to the mixture present in the reactor, the percentages corresponding to percentages with respect to the total weight of the starting reagents, The reactor was heated to a temperature of 140° C., The reactor was closed, the pressure ranging from 500 to 700 kPa and the temperature was maintained for a duration of 1 h, The reactor was opened then the residual water was removed by drawing off under vacuum;

9.4% by weight, with respect to the total weight of the starting reagents, of a Group I base oil of BSS type (kinematic viscosity at 100° C. of approximately 30 $mm^2/s$ measured according to the standard ASTM D-445 and density at 15° C. ranging from 895 to 915 $kg/m^3$) was added into the mixture, thus making it possible to reduce the temperature to 70° C., At this temperature 0.4% by weight, with respect to the total weight of the starting reagents, of a package of additives was added comprising an amine antioxidant (Irganox L57 from the BASF company), The mixture present in the reactor was then subjected to grinding using a Fryma corundum grinding mill from the frymaKoruma company.

Example 4

Process D for the Preparation of a Grease

A grease was prepared according to the process A, with the exception that the step of the addition of water at 57° C. and the step of the addition of acetic acid between 60 and 65° C. were reversed.

Example 5 (According to the Invention)

Process E for the Preparation of a Grease

A grease composition was prepared according to a process E according to the invention comprising the following steps:

- In a reactor, a mixture comprising 29.3% by weight of a Group I base oil of BSS type (kinematic viscosity at 100° C. of approximately 30 $mm^2/s$ measured according to the standard ASTM D-445 and density at 15° C. ranging from 895 to 915 $kg/m^3$), 37.6% by weight of a naphthenic Group I base oil (viscosity of 100 cSt at 40° C. measured according to the standard ASTM D-445) and 33.0% by weight of an overbased calcium sulphonate with a BN measured according to the standard ASTM D-2896 equal to 400 mg KOH/g of detergent was prepared, the percentages corresponding to percentages with respect to the total weight of the starting reagents,
- The mixture in the reactor was heated to a temperature of 75° C. according to a temperature gradient of 1.5° C./min,
- At a temperature of 50° C., 2.4% by weight of 12-hydroxystearic acid, with respect to the total weight of the starting reagents, and 0.01% by weight of an anti-foaming agent of silicone type, with respect to the total weight of the starting reagents, were added into the reactor,
- At a temperature of 55° C., 2.0% by weight, with respect to the total weight of the starting reagents, of dodecylbenzene sulphonic acid was added into the reactor,
- At a temperature of 57° C., 3.5% by weight, with respect to the total weight of the starting reagents, of water was added into the reactor,
- At a temperature of approximately 65° C., 0.6% by weight, with respect to the total weight of the starting reagents, of acetic acid was slowly added into the reactor,
- The reactor was closed then the temperature was raised to 90° C. and this temperature was maintained for a duration of 30 min,
- The reactor was opened and 1.2% by weight, with respect to the total weight of the starting reagents, of lime was added into the reactor at a temperature of 90° C.,
- The reactor was closed again,
- A pressure of 600 kPa was applied inside the reactor while heating in order to raise the temperature to 140° C.,
- This temperature was maintained for a duration of 1 h,
- Depressurizing was then applied to the reactor, the latter being carried out for at least 1 h at a temperature of 140° C. by opening the reactor (opening the bypass),
- At a temperature of 140° C. 8.4% by weight, with respect to the total weight of the starting reagents, of a Group I base oil of BSS type (kinematic viscosity at 100° C. of approximately 30 $mm^2/s$ measured according to the standard ASTM D-445 and density at 15° C. ranging from 895 to 915 $kg/m^3$) and 5.8% by weight of a naphthenic Group I base oil (viscosity of 100 cSt at 40° C. measured according to the standard ASTM D-445) were slowly added,
- The temperature was reduced to 80° C. according to a gradient of 2° C./min,
- At a temperature of 80° C. 0.5% by weight, with respect to the total weight of the starting reagents, of a package of additives comprising an amine antioxidant (Irganox L57 from the BASF company) and 1.5% by weight, with respect to the total weight of the starting reagents, of a package of additives comprising a detergent of salicylate type (M7121 from the Infineum company) were added,
- The mixture present in the reactor was then subjected to grinding using a Fryma corundum grinding mill from the frymaKoruma company.

The product obtained by the process E according to the invention is in the form of a smooth and shiny grease.

Example 6 (Comparative)

Process F for the Preparation of a Grease

A grease composition was prepared according to a comparative process F comprising the following steps:

- In a reactor, a mixture comprising 29.3% by weight of a Group I base oil of BSS type (kinematic viscosity at 100° C. of approximately 30 $mm^2/s$ measured according to the standard ASTM D-445 and density at 15° C. ranging from 895 to 915 $kg/m^3$), 37.6% by weight of a naphthenic Group I base oil (viscosity of 100 cSt at 40° C. measured according to the standard ASTM D-445) and 33.0% by weight of an overbased calcium sulphonate with a BN measured according to the standard ASTM D-2896 equal to 400 mg KOH/g of detergent was prepared, the percentages corresponding to percentages with respect to the total weight of the starting reagents,
- The mixture in the reactor was heated to a temperature of 75° C. according to a temperature gradient of 1.5° C./min,
- At a temperature of 50° C., 2.4% by weight of 12-hydroxystearic acid, with respect to the total weight of the starting reagents, and 0.01% by weight of an anti-foaming agent of silicone type, with respect to the total weight of the starting reagents, were added into the reactor,
- At a temperature of 55° C., 2.0% by weight, with respect to the total weight of the starting reagents, of dodecylbenzene sulphonic acid was added into the reactor,
- At a temperature of 57° C., 3.5% by weight, with respect to the total weight of the starting reagents, of water was added into the reactor,
- At a temperature of approximately 65° C., 0.6% by weight, with respect to the total weight of the starting reagents, of acetic acid was slowly added into the reactor,
- The temperature was raised to 90° C. and this temperature was maintained for a duration of 30 min,
- 1.2% by weight, with respect to the total weight of the starting reagents, of lime was added into the reactor at a temperature of 90° C.,
- The temperature was raised to 140° C. and maintained for a duration of 1 h,
- At this temperature of 140° C. 8.4% by weight, with respect to the total weight of the starting reagents, of a Group I base oil of BSS type (kinematic viscosity at 100° C. of approximately 30 $mm^2/s$ measured according to the standard ASTM D-445 and density at 15° C. ranging from 895 to 915 $kg/m^3$) and 5.8% by weight of a naphthenic Group I base oil (viscosity of 100 cSt at 40° C. measured according to the standard ASTM D-445) were slowly added, The temperature was brought back to 80° C. according to a gradient of 2° C./min, At a temperature of 80° C. 0.5% by weight, with respect to the total weight of the starting reagents, of a package of additives comprising an amine antioxidant (Irganox L57 from the BASF company) and 1.5% by weight, with respect to the total weight of the starting reagents, of a package of additives comprising a detergent of salicylate type (M7121 from the Infineum company) were added, The mixture present in the reactor was then subjected to grinding using a Fryma corundum grinding mill from the frymaKoruma company.

Thus, the process F does not comprises a pressurization step corresponding to step c) according to the invention. The product obtained by the process F is in the form of a liquid grease.

Test 1: Evaluation of the Preparation Time Associated with the Processes A, B and C.

In this case it is a question of evaluating the implementation time of the processes.

The preparation time of each grease obtained by the processes A, B and C respectively is described in Table III.

TABLE III

| | Grease obtained by the implementation of process A (process according to the invention) | Grease obtained by the implementation of process B (comparative process) | Grease obtained by the implementation of process C (comparative process) |
|---|---|---|---|
| Preparation time (h) | 8 | 8 | 14-16 |

The results of Table III show that the preparation time associated with the implementation of a process according to the invention (process A) is significantly shorter than that associated with the implementation of a two-phase process (process C).

Test 2: Evaluation of the Physico-Chemical Characteristics of the Greases Obtained by the Processes A, B and C.

In this case it is a question of evaluating the physico-chemical characteristics of the greases obtained by the processes A, B and C, and more particularly their grade. The NLGI grade of the greases A, B and C is described in Table IV.

TABLE IV

| | Grease obtained by the implementation of process A (process according to the invention) | Grease obtained by the implementation of process B (comparative process) | Grease obtained by the implementation of process C (comparative process) |
|---|---|---|---|
| NLGI grade[(1)] | 2 | 2 | 2 |

[(1)]cf Table II above.

The results show that the implementation of the process according to the invention (process A) makes it possible to obtain the same grade of grease as that obtained by a two-phase process (process C) or by a single-phase process but comprising a derivative of boric acid (process B). Thus, these results show that the physico-chemical characteristics of the greases obtained by a process according to the invention are maintained, compared with the greases obtained by a two-phase process or by a single-phase process but comprising a derivative of boric acid.

Test 3: evaluation of the properties of mechanical stability of the greases obtained by the processes A, B and C.

In this case it is a question of evaluating the mechanical stability of the greases obtained by the processes A, B and C, by measuring the penetrability and by the "Shell Roller" test. The penetrability is measured according to the standard ISO 2137 after 100,000 strokes and is expressed in 1/10 mm. The "Shell Roller" test is carried out according to the standard ASTM D1831 after 100 h at 80° C. and the results are expressed in 1/10 mm; this test principally consists of rolling the grease using rollers and makes it possible to evaluate the stability of a grease when the latter is rolled. The results are described in Table V.

TABLE V

| | Grease obtained by the implementation of process A (process according to the invention) | Grease obtained by the implementation of process B (comparative process) | Grease obtained by the implementation of process C (comparative process) |
|---|---|---|---|
| Penetrability | 292 | 300 | 292 |
| "Shell Roller" Test | 295 | 283 | 279 |

The results of Table V show that the mechanical stability of the greases obtained by the process according to the invention (process A) is maintained or even improved compared with a grease obtained by a two-phase process (process C) or by a single-phase process but comprising a derivative of boric acid (process B).

Test 4: Evaluation of the Properties of Thermal Resistance of the Greases Obtained by the Processes A, B and C.

In this case it is a question of evaluating the thermal resistance of greases obtained by the processes A, B and C by measurement of the dropping point and by evaluation of the bleeding. The dropping point is measured according to the standard NF T60-627 and is expressed in degrees Celsius. The bleeding after 50 h at 100° C. is evaluated according to the standard ASTM D6184 and is expressed in percentage corresponding to a percentage by mass of loss of oil. The bleeding after 168 h at 40° C. is evaluated according to the standard NF T60-191 and is expressed as a percentage corresponding to a percentage by mass of loss of oil. More particularly, the bleeding allows evaluation of the thermal stability of a grease; the lower the percentage obtained, the better the thermal resistance; evaluation of the bleeding is a good indication of the capacity of a thickener to retain the oil present in a grease. The results are described in Table VI.

TABLE VI

| | Grease obtained by the implementation of process A (process according to the invention) | Grease obtained by the implementation of process B (comparative process) | Grease obtained by the implementation of process C (comparative process) |
|---|---|---|---|
| Dropping point (° C.) | >300 | >300 | >300 |

TABLE VI-continued

| | Grease obtained by the implementation of process A (process according to the invention) | Grease obtained by the implementation of process B (comparative process) | Grease obtained by the implementation of process C (comparative process) |
|---|---|---|---|
| Bleeding 50 h/100° C. | 0.70 | 0.85 | 2.70 |
| Bleeding 168 h/40° C. | 0.47 | 0.77 | 0.74 |

The results of the table show that the implementation of a process according to the invention (process A) makes it possible to obtain calcium sulphonate complex greases the thermal resistance of which is not only maintained but is improved compared with a grease obtained by a two-phase process (process C) or by a single-phase process but comprising a derivative of boric acid (process B).

Test 5: Evaluation of the Shear Resistance Properties of the Greases Obtained by the Processes A and C In this case it is a question of evaluating the shear resistance, and more particularly the shear resistance when hot of the greases obtained by the processes A and C, by measurement of the viscosity as a function of the temperature. The viscosity is measured according to the standard DIN 51810-2 and is expressed in Pa·s. The results are described in Table VII.

TABLE VII

| Temperature (° C.) | Grease obtained by the implementation of process A (process according to the invention) | Grease obtained by the implementation of process C (comparative process) |
|---|---|---|
| 28 | 131.3 | 88.3 |
| 38 | 119.2 | 107.6 |
| 48 | 111.4 | 106.6 |
| 58 | 106.2 | 105 |
| 68 | 101.4 | 101.2 |
| 78 | 94.3 | 93.8 |
| 88 | 87.2 | 82.5 |
| 99 | 80.8 | 72 |
| 101 | 79.5 | 69.5 |
| 105 | 77.2 | 65.2 |
| 111 | 73.7 | 58.3 |
| 121 | 66.8 | 49.3 |
| 125 | 63.7 | 42.1 |
| 129 | 60.7 | 36.6 |
| 133 | 59.8 | 33.1 |
| 137 | 56.7 | 28.1 |
| 141 | 50.4 | 15.9 |
| 143 | 49.3 | 6.7 |
| 147 | 41.3 | 3.2 |
| 149 | 38.8 | 1.9 |
| 155 | 23.8 | 1.8 |
| 161 | 24.3 | 1.7 |
| 170 | 19.9 | 1.6 |
| 180 | 10.5 | 1.6 |

The results of Table VII show a significant difference in the behaviour when hot between a grease obtained by a process according to the invention (process A) and a grease obtained by a two-phase process (process C). In fact, the greases obtained by a process according to the invention show a small reduction in viscosity when the temperature increases, whereas the greases obtained by a two-phase process show a significant drop in viscosity, more particularly from 99° C. Thus, the greases obtained by a process according to the invention have a better thermal resistance when hot, and more particularly above 140° C.

Test 6: Evaluation of the Extreme-Pressure Properties of the Greases Obtained by the Processes A, B and C.

In this case it is a question of evaluating the extreme-pressure performances of the greases obtained by the processes A, B and C by the EP 4-ball test and by the FAG FE8 test. The EP 4-ball test is carried out according to the standard DIN 51350/4 and is expressed in daN. The FAG FE8 test is evaluated according to the standard DIN 51819 under the following conditions:

speed of rotation: 7.5 rpm,
load: 80 kN,
temperature: 160° C.,
duration of the test: 500 h,
ball bearings greased with each of the greases obtained by the processes A, B and C.

The results of the FAG FE8 test correspond to wear of the balls and are expressed in mg; the lower the values, the better the extreme-pressure performances. The results are described in Table VIII.

TABLE VIII

| | Grease obtained by the implementation of process A (process according to the invention) | Grease obtained by the implementation of process B (comparative process) | Grease obtained by the implementation of process C (comparative process) |
|---|---|---|---|
| EP 4-ball test | 380-400 | 420-440 | 420-440 |
| FAG FE8 test | <2/<2 | 2/4 | 39/16 |

The results of Table VIII show that the implementation of a process according to the invention (process A) makes it possible to obtain calcium sulphonate complex greases the extreme-pressure performances of which are not only maintained but are improved compared with a grease obtained by a two-phase process (process C) or by a single-phase process but comprising a derivative of boric acid (process B).

Test 7: Evaluation of the Anti-Corrosion Properties of the Greases Obtained by Processes A, B and C.

In this case it is a question of evaluating, by the Emcor test, the anti-corrosion properties of the greases obtained by the processes A, B and C. The Emcor test is evaluated according to the standard ISO 11007. The results are described in Table IX.

TABLE IX

| | Grease obtained by the implementation of process A (process according to the invention) | Grease obtained by the implementation of process B (comparative process) | Grease obtained by the implementation of process C (comparative process) |
|---|---|---|---|
| Emcor test | 0-0 | 0-0 | 0-0 |

The results show that the anti-corrosion performances of the greases obtained by the process according to the invention (process A) are maintained compared with a grease obtained by a two-phase process (process C) or by a single-phase process but comprising a derivative of boric acid (process B).

Test 8: Evaluation of the Anti-Wear Properties of the Greases Obtained by the Processes A, B and C In this case it is a question of evaluating the anti-wear properties of the greases obtained by the processes A, B and C, by implementation of the 4-ball test according to the standard ASTM D2266. The 4-ball test is implemented under the following conditions:

duration: 1 h, load: 40 kgs, temperature: 75° C.

The results are described in Table X.

TABLE X

| | Grease obtained by the implementation of process A (process according to the invention) | Grease obtained by the implementation of process B (comparative process) | Grease obtained by the implementation of process C (comparative process) |
|---|---|---|---|
| 4B wear test | 0.38 | 0.39 | 0.40 |

The results show that the anti-wear performances of the greases obtained by the process according to the invention (process A) are maintained compared with a grease obtained by a two-phase process (process C) or by a single-phase process but comprising a derivative of boric acid (process B).

Test 9: Evaluation of the Foaming Associated with the Process According to the Invention In this case it is a question of evaluating the existence of the foaming phenomenon during the implementation of the process according to the invention. Foaming can have harmful consequences for the process, it may in particular become apparent by a risk of the mixture present in the reactor overflowing and therefore a loss of product at the end of the process but also by a longer preparation time. Foaming can also have harmful consequences on the grease obtained at the end of the process, it could in particular become apparent by a deterioration in the physico-chemical properties of the grease. A grease according to process A and a grease according to process D were prepared. The phenomenon of foaming during the manufacture of the greases obtained by the process A and process D respectively was evaluated by visual observation. During the manufacture of the grease by process A according to the invention, no foaming phenomenon was observed, while process D for the manufacture of a grease caused significant foaming to appear.

Test 10: Evaluation of the Physico-Chemical Characteristics of the Greases Obtained by the Processes E and F In this case it is a question of evaluating the physico-chemical characteristics of the greases obtained by the processes E and F, and more particularly their grade. The NLGI grade of greases E and F is described in Table XI.

TABLE XI

| | Grease obtained by the implementation of process E (process according to the invention) | Grease obtained by the implementation of process F (comparative process) |
|---|---|---|
| NLGI grade[(1)] | 1.5-2 | Not measurable |

[(1)]cf Table II above.

The results show that the implementation of the process according to the invention (process E) makes it possible to obtain a grease with the required grade, while the implementation of the comparative process (process F) not comprising a pressurization step according to the invention leads to a liquid grease that does not in any way correspond to the grade sought.

Test 11: Evaluation of the Thermal Resistance Properties of the Greases Obtained by the Processes E and F.

In this case it is a question of evaluating the thermal resistance of greases obtained by the processes E and F by measuring the dropping point. The dropping point is measured according to the standard NF T60-627 and is expressed in degrees Celsius. The results are described in Table XII.

TABLE XII

| | Grease obtained by the implementation of process E (process according to the invention) | Grease obtained by the implementation of process F (comparative process) |
|---|---|---|
| Dropping point (° C.) | >300 | Not measurable (liquid product) |

The results show that the implementation of a process according to the invention (process E) makes it possible to obtain a grease having a good thermal resistance, whereas the implementation of a comparative process (process F) not comprising a pressurization step according to the invention leads to a liquid grease the thermal resistance of which cannot be evaluated. Thus, the examples above demonstrate the benefit of the implementation of the process according to the invention for the preparation of a calcium sulphonate complex grease compared with a two-phase process, making it possible to have a significantly reduced preparation time. In addition, the calcium sulphonate complex greases obtained by the process according to the invention retain a good mechanical stability, good anti-corrosion and anti-wear performances while having improved thermal resistance and extreme-pressure performances despite the absence of boric acid. The examples also show the importance of step c) according to the invention with the objective of obtaining of calcium sulphonate complex greases having a satisfactory structure as well as physico-chemical, mechanical and thermal resistance properties.

The invention claimed is:

1. A process for the preparation of a calcium sulphonate complex grease comprising at least the following steps:

a) preparing, in a reactor, a calcium sulphonate complex soap comprising calcium carbonate, the calcium carbonate being presented in the form of calcite, said preparing comprising the steps of:

a.i) mixing, in the reactor, at least one base oil and at least one overbased calcium sulphonate, a.ii) adding at least one carboxylic acid comprising at least 12 carbon atoms, and optionally at least one OH group, at a temperature of at least 20° C., a.iii) adding at least one sulphonic acid comprising at least 12 carbon atoms at a temperature of at least 50° C., a.iv) adding water at a temperature of at least 50° C., a.v) adding at least one carboxylic acid comprising at least 2 carbon atoms at a temperature of at least 50° C., a.vi) closing the reactor, a.vii) raising the temperature to a temperature of at least 80° C., a.viii) opening the reactor, and a.ix) adding lime at a temperature ranging from 90° C. to 95° C., wherein the at least one base oil, the at least one overbased calcium sulphonate, the at least one carboxylic acid comprising at least 12 carbon atoms and optionally at least one OH group, the at least one sulphonic acid, the water, the least one carboxylic acid comprising at least 2 carbon atoms, and the lime are starting reagents, b) closing the reactor, c) raising the temperature in the reactor from the temperature ranging from 90° C. to 95° C. to a temperature ranging from 130° C. to 160° C. under a pressure ranging from 400 kPa to 700 kPa, said temperature and pressure being maintained for a duration of at least 60 min, d) depressurizing and removing the water contained in the reactor, and e) cooling the reactor to lower the temperature to a temperature of less than or equal to 90° C., the process not comprising the addition of boric acid or a derivative of boric acid.

2. The process according to claim 1 in which steps a.i) to a.iii) are implemented in a different order.

3. The process according to claim 1 in which the content by weight of calcium sulphonate ranges from 35 to 55% with respect to the total weight of the starting reagents and the content by weight of base oil ranges from 45 to 65% with respect to the total weight of the starting reagents.

4. The process according to claim 1 in which the carboxylic acid of step a.ii) is selected from the carboxylic acids or the hydroxycarboxylic acids comprising from 12 to 24 carbon atoms.

5. The process according to claim 1 in which the content by weight of carboxylic acid added in step a.ii) ranges from 1 to 4% with respect to the total weight of the starting reagents.

6. The process according to claim 1 in which the sulphonic acid of step a.iii) is selected from the sulphonic acids of formula (I):

$$[(R_1\text{-}A)_x\text{-}SO_3M_y] \quad (I)$$

in which:

$R_1$ represents a saturated or unsaturated, linear or branched alkyl group, comprising at least 10 carbon atoms;

A represents an aromatic hydrocarbon-containing group;

M represents a hydrogen atom or a calcium atom;

x represents 1 or 2;

y represents 1 or 2;

when M represents a calcium atom, y represents 2, and when M represents a hydrogen atom, y represents 1.

7. The process according to claim 1 in which the content by weight of sulphonic acid added in step a.iii) ranges from 0.5 to 4% with respect to the total weight of the starting reagents.

8. The process according to claim 1 in which the content by weight of water added in step a.iv) ranges from 1 to 10% with respect to the total weight of the starting reagents.

9. The process according to claim 1 in which step a.iv) is implemented at a temperature ranging from 50 to 60° C.

10. The process according to claim 1 in which the carboxylic acid of step a.v) is selected from the carboxylic acids comprising from 2 to 6 carbon atoms.

11. The process according to claim 1 in which the content by weight of carboxylic acid added in step a.v) ranges from 0.1 to 1% with respect to the total weight of the starting reagents.

12. The process according to claim 1 in which step a.vii) is implemented at a temperature of at least 85° C.

13. The process according to claim 1 in which the content by weight of lime added in step a.ix) ranges from 0.1 to 4% with respect to the total weight of the starting reagents.

14. The process according to claim 1 in which the pressure in the reactor in step c) is maintained at a pressure ranging from 500 to 650 kPa at a temperature ranging from 130 to 150° C.

15. The process according to claim 1 comprising a step d.i) implemented after step d) and before step e) and comprising the supplementary addition of at least one base oil.

16. The process according to claim 1 comprising a step f) implemented after step e) and comprising the addition of at least one supplementary additive, optionally followed by a step of grinding the product obtained.

17. The process according to claim 1, wherein the process is a single phase process in which the temperature is continuously raised to the temperature ranging from 130° C. to 160° C. at a rate of 1 to 3° C./min and the cooling the reactor is performed by decreasing the temperature at a rate of 1 to 3° C./min.

* * * * *